United States Patent [19]

Takeda et al.

[11] 4,376,896

[45] Mar. 15, 1983

[54] SWITCHING ASSEMBLY

[75] Inventors: Nobuhiro Takeda; Shigeo Mizuno; Yukio Takaishi; Masaichi Hattori, all of Nagoya, Japan

[73] Assignee: Kabushiki Kaisha Tokai Rika Denki Seisakusho, Aichi, Japan

[21] Appl. No.: 139,273

[22] Filed: Apr. 10, 1980

[30] Foreign Application Priority Data

Jul. 30, 1979 [JP] Japan ..... 54-104089[U]

[51] Int. Cl.[3] ..... H01H 21/60; H02H 7/085

[52] U.S. Cl. ..... 307/115; 307/142; 307/154; 361/86; 361/31; 361/194; 335/165; 335/164; 318/469

[58] Field of Search ..... 307/115, 140, 142, 154; 335/186, 165, 164; 361/86, 31, 194; 318/282, 280, 286, 466–469; 340/147.2 P; 200/1 V

[56] References Cited

U.S. PATENT DOCUMENTS 4,119,899 10/1978 Sumida ..... 318/469

*Primary Examiner*—Stafford D. Schreyer

*Attorney, Agent, or Firm*—Wenderoth, Lind & Ponack

[57] ABSTRACT

A switching assembly to be incorporated in a window-regulator for a motor vehicle and the like, which includes paired units of switching members, each of which is arranged to serve for operating an electric motor in either of two rotational directions in a manual mode or in an automatic mode subject to the displacing amount of a single switching knob, and an electric circuit means including a solenoid for selectively self-retaining and self-releasing the automatic operating mode. The switching assembly is arranged to be capable of selectively energizing and de-energizing the electric motor incorporated in the window-regulator together with operating the solenoid simultaneously.

5 Claims, 17 Drawing Figures

SWITCHING ASSEMBLY

BACKGROUND OF THE INVENTION

This invention generally relates to an electrical switch, and more particularly, to a switching assembly for use in a motor vehicle and the like, which is capable of actuating an electric motor for a window-regulator either in a manual mode or in an automatic mode for rotation of the electric motor either in a forward direction or a reverse direction, thereby to cause a powered control system of windows of motor vehicles to be selectively lowered and raised either in a manual mode or in an automatic mode.

There have been already proposed a number of switching means or assemblies each to be used for actuating an electric regulator incorporated in a powered-control system of windows of motor vehicles. According to such conventional switching means as described above, in a manual switching mode, the windows are arranged to be selectively lowered and raised, so long as the switching means are actuated, while in an automatic switching mode, the windows are arranged to be fully opened or closed, once an initial actuation of the switching means is accomplished.

More specifically, according to the conventional constructions of the switching means of the above-described type, a switching knob is arranged to actuate the switching means in a two-staged manner, in either of a rightward direction and a leftward direction, so that the switching means is adapted to be operable for making the window regulator to be operated either in the manual mode subject to a manipulation or a depression of the switching knob to a first stage or in the automatic mode subject to a further manipulation of the switching knob to a second stage. By the conventional constructions of the switching means, electric contacts for causing the electric motor to be electrically energized are first closed by disposing the switching knob at the first stage, while shifting to the second-stage via the first staged position permits a solenoid to be electrically energized, thus resulting in the switching knob being electromagnetically retained at the second stage. However, since the conventional construction of the switching means of the above-described type are not arranged to energize or de-energize the motor and the solenoid simultaneously, respective electric contacts for electrically actuating both of the motor and the solenoid are separately needed, thus resulting in the fact that the switching means can not be assembled in a compact size.

On the other hand, for the switching arrangement for the regulator, a switching means of a see-saw type has often been alternatively employed as the means, wherein the knob is arranged to be pivotally moved selectively rightwardly and leftwardly with respect to a common contact, thereby to selectively cause either of electric contacts of the switching means to be in the manual switching mode. Therefore, according to the construction of such a switching means as described above, there are provided a pair of auto-switching units, each being disposed on either side of the switching knob and comprising two plate-like contacting members of leaf springs, wherein each of the auto-switching units is so arranged that one of the contacting members is alternatively in contact or out of contact with the other, subject to the condition that the pressure, which is caused by the further pivotal movement of the switching knob, acts upon the auto-switching units so that the switching knob may be electromagnetically attracted and retained in the second position, and vice versa. Accordingly, the conventional switching means is inherently complex in construction, especially in construction in respect to the mutual arrangement of the electrical contacting members, and can not be formed in a compact size. As described earlier, since the electric contacts of the switching means of the see-saw type also contain the common electric contact for controlling the rotational movement of the electric motor, the permissible flow capacity of the electric current is not arranged to be higher when compared with the switching means of the other conventional switching means, and, in addition, the fatigue performance is substantially high. Furthermore, in window-regulators including the conventional switching means of the above-described type, auxiliary switching means such as a micro-switch and the like are usually incorporated, so that the completion of the lowering operation or that of the raising operation may be detected and then, the energization of the solenoid is stopped by the resultant actuations relating to the auxiliary switching means. As a result, there have been additionally involved a number of undesirable problems in connection with the introduction of the auxiliary switching means into the window-regulator.

As is clear from the description in the foregoing, the switching means of the above-described two-staged type as well as the switching means of the see-saw type respectively involve a number of specific defects, which should be improved, and according to the present invention, some defects, especially, those relating to the switching means of the above-described two-staged type are substantially improved as will be described hereinafter.

SUMMARY OF THE INVENTION

Accordingly, an essential object of the present invention is to provide a switching assembly capable of actuating an electrical motor for an electric regulator either in a manual mode or in an automatic mode with the help of a solenoid in such a manner that it can be rotated selectively in one direction and in a reverse direction.

Another important object of the present invention is to provide a switching assembly of the above-described type, which is arranged to serve for controlling respective operations of the electric motor together with its operating mode retaining means by the drive of only one unit of switching contacting members with a single switching knob per one directional operation of the electric regulator.

A further object of the present invention is to provide a switching assembly of the above-described type, which is compact in size and highly efficient in use.

A still further object of the present invention is to provide a switching assembly of the above-described type, which can be manufactured at low cost.

In accomplishing these and other objects according to one preferred embodiment of the present invention, there is provided a switching assembly to be incorporated in a window-regulator as will be described hereinbelow.

The switching assembly comprises:

a knob capable of being pivotally moved selectively clockwise and counterclockwise, with its operation leg portion being maintained in a downwardly urged condition;

a pivotal angle adjusting means, which is symmetric in configuration and defines respective paired first and second stages on either side of a basic stage, to thereby to permit the operating leg portion of the knob to be selectively, pivotally driven to one of the paired first operating stage and the second operating stage via the first operating stage, when the knob is pivotally moved selectively clockwise and counterclockwise with respect to a pivotal center;

two paired electric change-over contacts each having a common contact electrically connected to a terminal of an electric motor, wherein each of the two paired electric change-over contacts is correspondingly changed over in association with the selective clockwise and counterclockwise drive of the operating leg portion with the help of a member interconnecting the operating leg portion with the respective electric change-over contacts;

a solenoid means capable of retaining the knob at one of the second stages subject to the condition that the knob is pivotally driven to the corresponding one of the second stages;

an actuating means including a transistor for detecting an excess flow of the electric current through the electric motor; and an electric circuit wherein the solenoid means is electrically connected with each of the common contacts through each diode.

More specifically, the solenoid means as described above comprises a bobbin around which coil is wound; a plunger which is almost entirely accommodated inside a through-bore of the bobbin and includes a core portion and, on either side of the core portion, a pair of end-portions each having a relatively smaller diameter; an approximately U-shaped yoke member having an electromagnetizable side plate in which an opening is provided for permitting one of the end-portions to pass through; and an electromagnetizable plate member having an opening through which the other of the end-portions is to be passed when assembled, while the electromagnetizable plate being arranged to fit to the approximately U-shaped yoke member to thereby provide a box-like configuration. According to the present invention, the solenoid means is so arranged that the core is adapted to be selectively in electromagnetical contact with one of the magnetizable side plate of the approximately U-shaped yoke and the magnetizable plate with the help of the interconnecting member, subject to the condition that the operating leg portion of the knob is selectively driven to one of the second stages. Furthermore, the actuating means described above further includes series-connected resistors of the resistance division type connected to respective diodes; a comparator whose one input terminal is connected to both of the electrically breaking contacts of the respective two paired electric change-over contacts, with the other input being connected with the resistors through a division or branch point of the resistor; both of electrically breaking contacts are respectively electrically connected to a minus electrode of an electric source; and an electric current detecting resistor positioned between the division point and the minus electrode, wherein an output of the comparator is connected to an input of the transistor, such that when the above-described one input terminal of the comparator is at a higher electric potential than the above-described other input terminal, the transistor is rendered to be in an ON-state, and the solenoid means is energized through a corresponding one of the diodes. As far as the de-energization of the solenoid means is concerned, the solenoid means is de-energized with the condition reversed relative to the condition as described above.

By the arrangement as described in the foregoing, the switching assembly of the present invention is capable of selectively energizing and de-energizing the motor incorporated in the window-regulator together with the solenoid means simultaneously, whereby the window-regulator is operated either in the manual mode or in the automatic mode subject to the displacing amount of the knob.

BRIEF DESCRIPTION OF THE DRAWINGS

These and other objects and features of the present invention will become apparent from the following description taken in conjunction with the preferred embodiment thereof with reference to the accompanying drawings in which.

Before the description of the present invention proceeds, it is to be noted that like parts are designated by like reference numerals throughout several views of the accompanying drawings, unless otherwise denoted.

DETAILED DESCRIPTION OF THE INVENTION

Referring now to FIGS. 1 to 7, there is shown a switching assembly according to the present invention, which is used for electrically actuating a window-regulator for use in selectively opening and closing window in an automatic or a manual manner.

Figure 4:
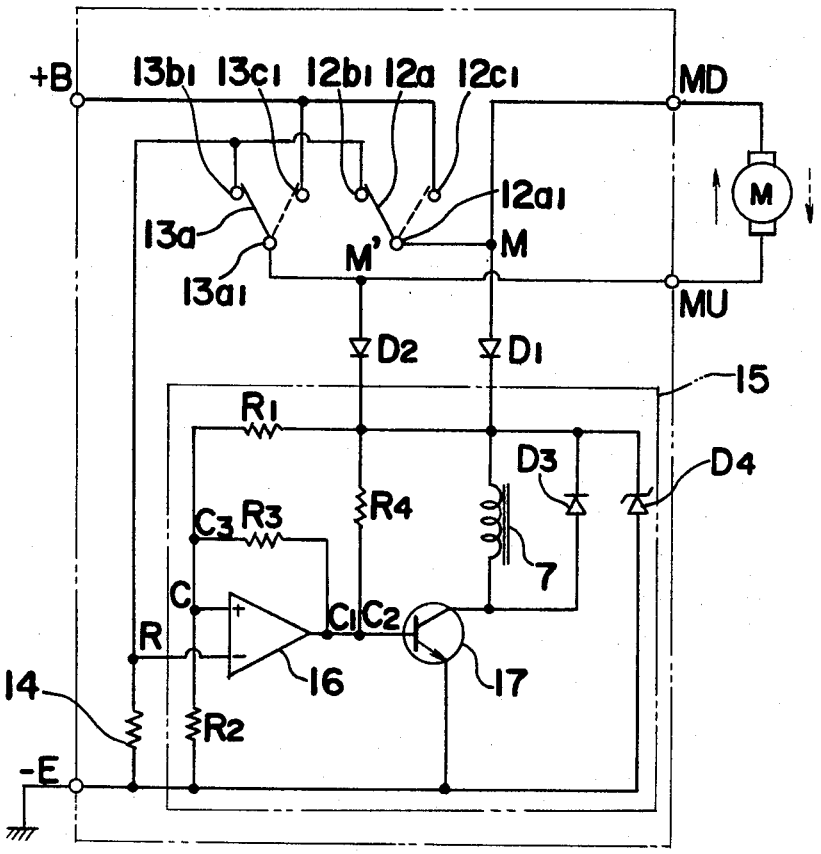
FIG. 4 is an electric circuit diagram of a window-regulator in conjunction with the switching means according to the present invention.
Figure 5:
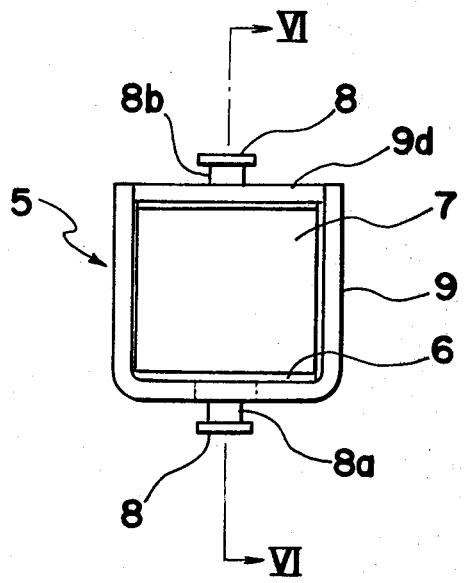
FIG. 5 is a schematic, front view of a solenoid, which is employed in the arrangement of FIG. 1.
Figure 6:
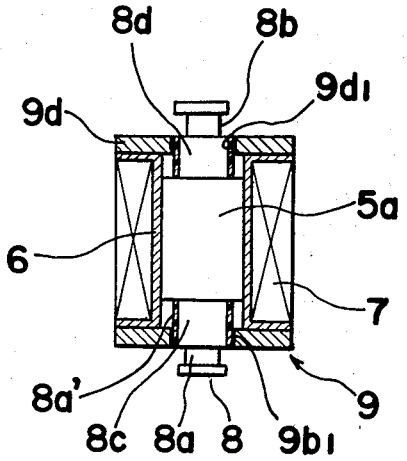
FIG. 6 is a sectional view taken along the line VI—VI of FIG. 5.
Figure 7:
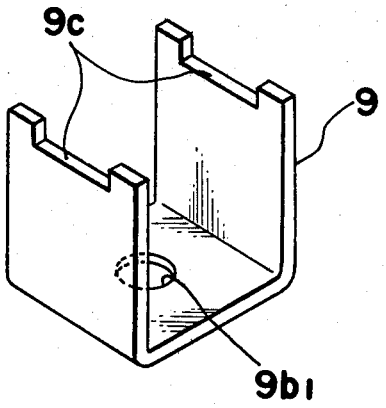
FIG. 7 is a schematic, perspective view of a yoke of the solenoid shown in FIG. 5.

The switching assembly essentially comprises a knob 1, an operating portion 1*a* which is downwardly tapered towards its bottom end, a solenoid means 5, a casing 2, an interconnecting means 10, a switching means and a relating circuitry arrangement including a self-retaining and self-releasing circuit 15 shown in FIG. 4. More specifically, the knob 1 includes a pressing portion 1*g*, the operating portion 1*a* arranged to be downwardly projected from a rear face of the pressing portion 1*g* and a portion (not shown) facing the portion 1*a*, wherein the operating portion 1*a* is further provided with an internal groove 1*e* opened outside at its bottom end. A top configuration of the pressing portion 1*g* is arranged to be centrally recessed while being provided with paired shoulders 1*c* and 1*d* on either side of the recessed pressing portion 1*g*. The operating portion 1*a* includes a lug 1*b* provided on its outer circumference, which is arranged to be engageable with a corresponding aperture provided for the casing 2 so that the knob 1 can be selectively moved pivotally while associated with the above portion (not shown) subject to a selective application of pressure upon either of the shoulders 1*c* and 1*d*, a groove-portion $1a_1$ on a rear side relative to the side whereat the lug 1*b* is provided and a combination of a spring 3 and a pin-member 4, which is set inside the internal groove 1*e*.

The solenoid means 5 of the present invention is assembled in a recessed portion 2*a* provided for the casing 2. As is specifically shown in FIGS. 5 to 7, the solenoid means comprises a bobbin 6 around which a coil 7 is wound, a plunger 8 which is almost entirely accommodated inside a through-bore of the bobbin 6, an approximately U-shaped or a yoke member 9 having an electromagnetizable plate 9*b* and an electromagnetizable plate member 9*d*. The plunger 8 includes a core portion 5*a* and a pair of end-portions 8*c* and 8*d* on either side of the core portion 5*a*; each end portion having a relatively small diameter and sometimes covered by a coating 8*a* of appropriate plastic materials. Furthermore, the respective end-portions 8*c* and 8*d* are provided with respective circularly grooved portions 8*a* and 8*b*. The plunger 8 almost entirely accommodated inside the bobbin 6 is slidably disposed inside a box-like member formed by coupling the plate member 9*d* to one of the open sides of the yoke member 9, wherein each of the end-portions 8*c* and 8*d* is however, extended outwardly from an opening $9b_1$ and an opening $9d_1$ respectively provided in the magnetizable plate 9*b* and the magnetizable plate member 9*d*. As is specifically shown in FIGS. 5 to 7, the solenoid means 5 of the present invention includes only one coil member, and the plunger 8 is selectively moved forwardly and backwardly with respect to its longitudinal axis and retained in respective positions to be shifted through the electromagnetical effects to be involved as will be specifically described hereinafter.

The interconnecting member 10, which is made of any one of the plastic materials or the like, has a pair of arms 10*a* and 10*b*, both being parallelly extended with respect to each other, wherein both arms are provided with respective cut-off portions $10a_1$ and $10b_1$, to thereby enable them to be coupled to the corresponding groove-portions 8*a* and 8*b* of the plunger 8 therewith. Furthermore, the interconnecting member 10 is integrally provided with a U-shaped frame 10*c* extending in the reverse direction relative to that of the paired arms 10*a* and 10*b*, and is provided with a lug 10*d* on the rear face of the interconnecting portion 10*e* which is arranged in such a manner that the operating member 1*a* is capable of being inserted into the U-shaped frame 10*c*, and with the lug 10*d* being also capable of being accommodated inside the groove-portion $1a_1$ of the operating member 1*a*.

The casing 2 is made of any one of the plastic materials or the like, and is formed in an approximately box-like configuration. As can be seen from FIG. 1, the respective top and bottom of the casing 2 are both omitted. However, a pair of triangle-shaped plate-portions 2*d*, which face each other, are respectively coplanarly extended upwardly from what is substantially the top boundary of the casing 2. The triangle-shaped plate portions 2*d* are respectively provided with openings $2d_0$, to which the lug 1*b* of the operating member 1*a* and a lug (not shown here) of the facing portion (not shown here) of the knob 1 are respectively inserted. On the other hand, the bottom boundary of the casing 2 is further arranged to have a pair of rectangular shaped plate-portions 2*f*, which are facing each other, on both sides of the boundary of the bottom and coplanarly extended downwardly from what is substantially the bottom boundary of the casing 2. The rectangular-shaped plate-portions 2*f* are respectively provided with openings 2*e*, to which respective engageable portions 11*a*, which are provided in the switching assembly 20, are coupled. Inside the casing 2, there are provided a through portion 2*c* running along the long-side of the casing 2 and accommodating a pivotal angle adjusting member 2*b* therein and box-like recessed portion 2*a* to which the yoke 9 is fixedly coupled. To the trough portion $2c_0$, the pivotal angle adjusting member 2*b* is coupled so that the pin-member 4 urgedly projected from the bottom of the operating portion 1*a* may be slidably moved on the pivotal angle adjusting member 2*b* as will be specifically described hereinbelow. By the arrangement as described in the foregoing, the operating portion 1*b* of the knob 1 can be inserted into a rectangular opening $10c_1$ provided in the interconnecting member 10, and the lug 10*d* provided in the interconnecting member 10 being in turn introduced into the groove-portion $1a_1$ provided in the operating portion 1*a*. Furthermore, the respective lugs 1*b* of the operating portion 1*a* and the above-described member of the knob 1 are inserted into the respective openings $2d_0$ of the casing, whereby the knob 1 can be pivotally moved selectively clockwise and counterclockwise with respect to the lugs 1*b*. As a matter of fact, it might be rather difficult to assemble the knob 1 in a manner as described above, if the casing 2 is not made of a resilient material such as the plastic material of this embodiment of the present invention.

When the knob 1 is in a predetermined position, the pin-member 4 projected from the bottom of the operating portion 1*a* is urged towards an upper circumference of the pivotal angle adjusting member 2b at its leading end.

As far as the pivotal angle adjusting member 2b is concerned, an upper circumferential configuration is arranged to be symmetrical and comprises a central circumferential portion inwardly sloped $2b_1$, a pair of local portions $2b_2$, stepwisely provided on either outer side of the central circumferential portion $2b_1$, and a pair of sloped outer circumferential portions $2b_3$ provided on either outer side of the locally stepwise portions described above. The detailed cross-sectional feature of the pivotal angle adjusting member 2b is specifically shown in FIG. 2. As long as the knob 1 is kept in a normal or neutral state wherein the pressing portion 1g itself is kept in a substantially horizontal situation, the pin member 4 is urged towards what is substantially the lowest circumferential portion of the pivotal angle-adjusting member 2b at its leading end as specifically shown by a solid, rather than dotted line in FIG. 2.

The switching means 20 comprises a covering member 11 provided with a pair of lugs 11a of the half slanted type on both recessed portions of the long side dimension of the covering member 11, thereby to make them easily engaged by the respective engageable openings 2e provided in the casing 2, two sets of electrically contacting plate members 12 and a 13, and self-retaining and -releasing circuit 15 described hereinafter, wherein the two sets of members 12 and 13 together with the circuit 15 are mounted on the inner surface of the covering member 11. One set 12 of electrical contacting plate members is prepared for actuating an electrically driven motor to open windows of a four wheeled vehicle, while the other 13 is provided for actuating the electrically driven motor to close the windows described above. Each of the two sets of electrical contacting plate members includes a pair of fixedly disposed contacting plate members, one of which is arranged to be functioned as an electrical breaking contacting plate member, and a movable contacting plate member interposed between the fixedly disposed contacting members described above, to thereby make it to be adapted to be in contact with either of the pair of fixedly disposed contacting plate members. More particularly, one set 12 includes the electrical breaking contacting plate member 12b, the other fixedly disposed contacting plate member 12c and the movable contacting plate member 12a; the other set 13 includes the electrical breaking contacting plate member 13b, the other fixedly disposed contacting plate member 13c and the movable contacting plate member 13a, accordingly. When the switching assembly is in a non-actuating mode, a contact $12a_1$ provided on the movable contacting plate member 12a is in contact with a contact $12b_1$ provided on the electrical breaking contacting plate member 12b; a contact $13a_1$ provided on the movable contacting plate member 13a is in contact with a contact $13b_1$ provided on the electrical breaking contacting plate member 13b. The contacting situation described above is specifically shown in FIG. 4. Furthermore, each of the sets 12 and 13 stands substantially upwardly inside the respective openings 2c positioned on either side of the trough-like portion $2c_0$; respective top portions of the movable contacting plate members 12a and 13a are arranged to be in close contact with respective short-side ends $10c_2$ of the U-shaped frame 10c, when the switching means is in the non-actuating mode. Accordingly, in association with an actuation of the pressing portion in either the clockwise or counterclockwise direction with respect to the lug 1b, either of the movable contacting plate members 12a and 13a is correspondingly pivotally moved rightward or leftward with either of the short-side ends $10c_2$ of the U-shaped frame 10c, whereby either of the movable contacting plate members 12a and 13a is forcibly in contact with with corresponding one of the contacts $12c_1$ and $13c_1$, and the switching circuit is correspondingly changed over.

Referring now to FIG. 4, there is shown the circuit arrangement of a window regulator according to the present invention, to which the present switching means and its driving means are incorporated. As can be seen in FIG. 4, respective numeral numbers $12b_1$ and $13b_1$ designate respective contacts provided on the respective breaking contacting plate members 12b and 13b; respective numeral members $12c_1$ and $13c_1$ designate respective contacts provided on the respective fixedly disposed contacting plate member 12c and 13c. The respective contacts $12c_1$ and $13c_1$ provided on the respective fixedly disposed contacting plate member 12c and 13c are both electrically connected to a plus-electrode B of an electric source. On the other hand, both the contact $13b_1$ provided on the breaking contacting plate member 13b for opening the windows and the contact $12b_1$ provided on the breaking contacting plate member 12b for closing the windows are respectively electrically connected to a minus-electrode E of the electric source through a current detecting resistor 14. The movable contacting member 12a and the movable contacting plate member 13a are respectively connected to a logical operation circuit or the electrically self-retaining and self-releasing circuit 15 through respective diodes D1 and D2; both members 12a and 13a are also each electrically connected to one of terminals of the electric driven motor M. By the arrangement as described above, when the electric current is to flow in a direction denoted by a solid arrow, the electric motor M is arranged to be energized so as to cause the windows to be raised. On the other hand, when the electric current is to flow in a direction denoted by a broken arrow, the electric motor M is adapted to be energized so as to cause the windows to be lowered or to be opened.

As far as the logical operation circuit 15 is concerned, respective components are arranged to function as follows.

Respective notations $R_1$ and $R_2$ designate resistors of the resistance division type or distributed resistors. The resistors $R_1$ and $R_2$, both being used for serving for the generation of the reference electric potential, are respectively connected in series to both of the diodes D1 and D2, so that the electric current of the the setting off or releasing signal is determined. A numeral 16 designates a comparator. One input terminal thereof is connected to both of the breaking contacting plate members 12b and 13b, and the other input terminal thereof is connected to the resistors $R_1$ and $R_2$ of the above-described type at a division or branch point C of the series combination. According to the comparator 16, in a case wherein its plus terminal connected to the division point C is higher in electric potential than its minus terminal connected to a junction R positioned immediately before the location of the current detecting resistor 14, an output terminal of the comparator 16 is rendered to be high in electric potential. However, when the electric potential across the current detecting resistor 14 is rendered to be high in association with an increase of the flow of the electric current there-through, which is caused by the functional characteristics of the electric motor M, the output terminal of the comparator 16 is in turn rendered to be low, and accordingly, a transistor 17, which is connected to the output terminal of the comparator 16, is rendered to be in an OFF-mode. A notation $R_3$ designates a resistor for effecting a hysteresis effect, one end of which is connected to the comparator 16 through a junction point $C_1$, while the other is connected to a junction point $C_3$ positioned between the resistor $R_1$ of the above-described type and the input terminal C of the comparator 16. A notation $R_4$ designates a base resistor of the transistor 17, and a numeral member 7 is the aforementioned coil member of a solenoid 5. One end of the coil member 7 is connected to one end of the diode $D_1$ and the other end thereof is connected to the collector of the transistor 17. A notation $D_3$ designates a diode functioning as a component for suppressing the counter electromotive force to be caused by the coil member while in operation. A notation $D_4$ designates a diode functioning as a component for absorbing the surge effect to be caused by the electric motor M.

By the arrangement described in the foregoing, the window-regulator shown in FIG. 4 functions as follows.

As long as the knob 1 is not actuated, the contact $12a_1$ is in contact with the contact $12b_1$, and the contact $13a_1$ is in contact with the contact $13b_1$, whereby the motor M is not energized.

Figure 1:
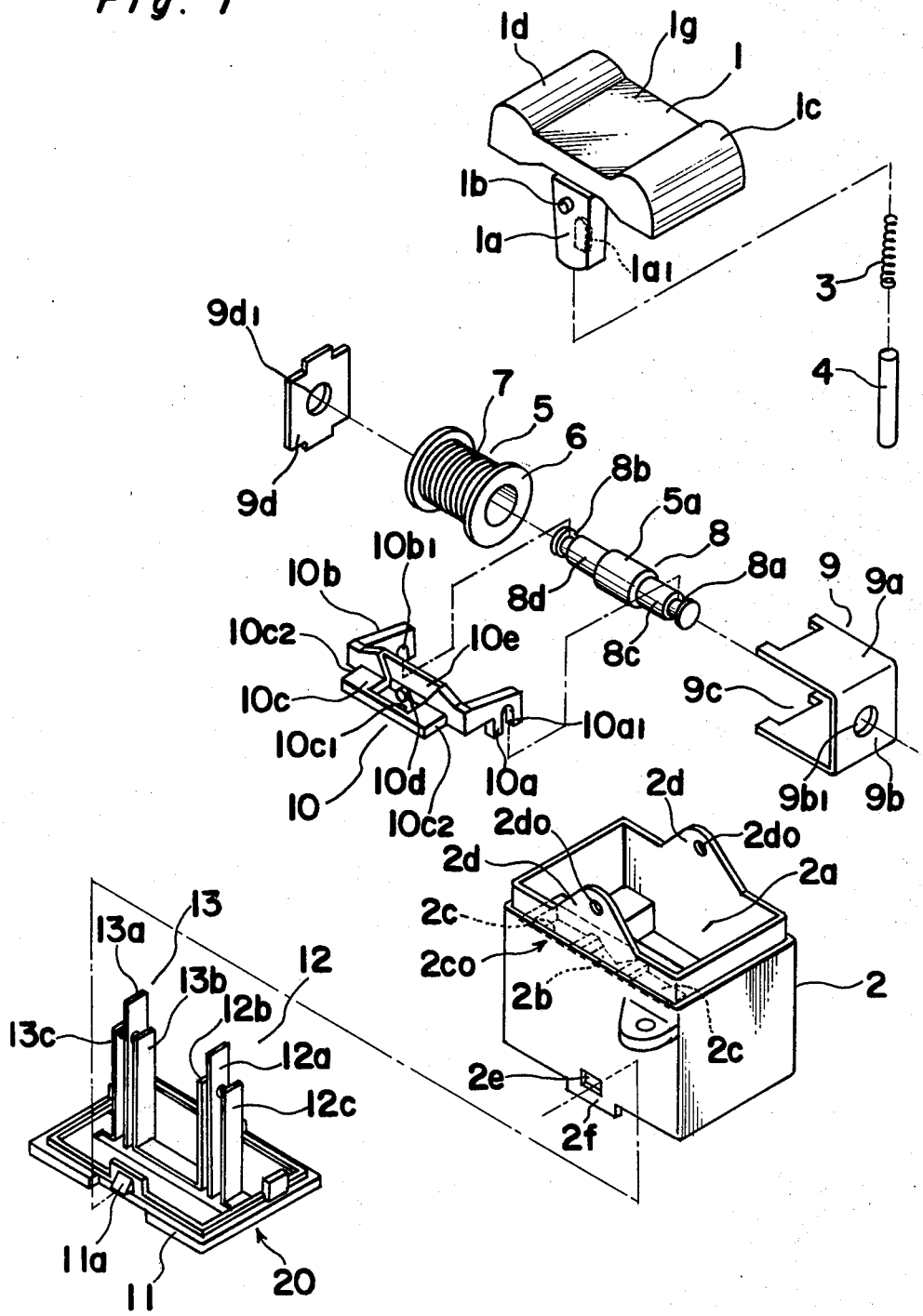
FIG. 1 is a schematic, perspective view of a switching assembly according to the present invention, but particularly showing a disassembled state of the switching assembly.
Figure 2:
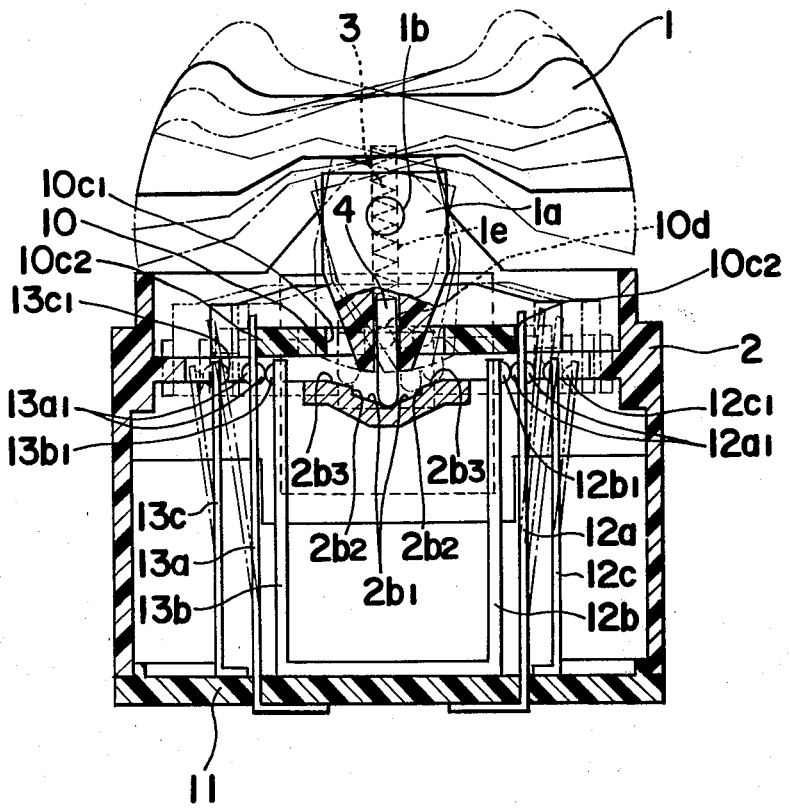
FIG. 2 is a schematic, front sectional view of the switching assembly of FIG. 1.
Figure 3:
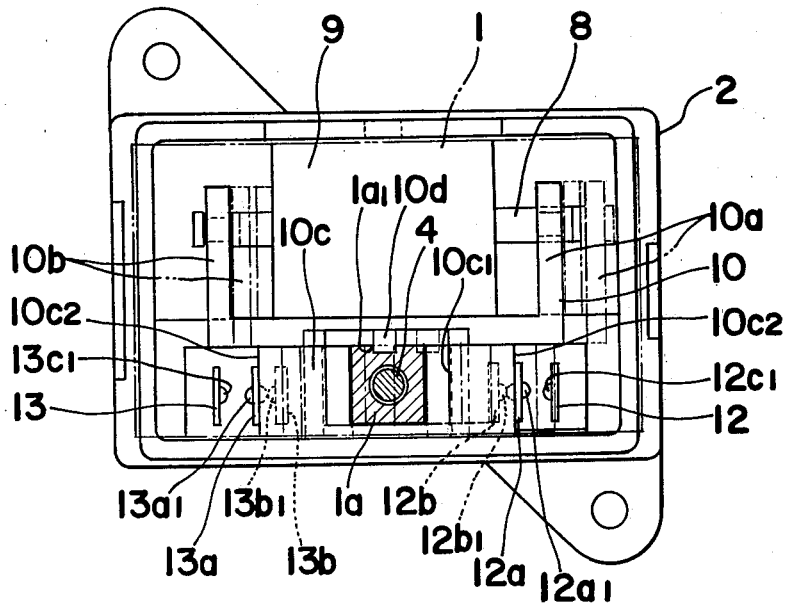
FIG. 3 is a schematic, top plain view of the switching assembly of FIG. 1.

In a case wherein the knob 1 is pressed at its shoulder 1*d*, starting from the above-described non-actuating state, the pin-member 4 is kept slidably moved on a sloped surface of the central circumferential portion $2b_1$ until the leading end of the pin-member 4 is prevent from further moving by the side of the shoulder-like step-portion $2b_2$ (see FIGS. 1 and 2). One who keeps pressing the shoulder 1*d* of the knob 1 knows that the window-regulator is in a semi-automatic or a manual mode at the moment when the pin-member 4 is prevented from further moving as described above. In association with pressing of the shoulder 1*d*, the operating portion 1*a* is pivotally moved counterclockwise with respect to the lug 1*b* as shown in FIG. 2. Furthermore, the interconnecting member 10 with which the operating portion 1*a* is engaged, through the lug and aperture connection, is moved towards the right in FIG. 2 in association with the above-described pivotal movement, whereby the movable contacting plate member 12*a* of the set 12 is forcibly pushed such that contact $12c_1$ is in contact with the contact $12a_1$. Accordingly, as is clear from the above description, the contact $12a_1$ is changed over to the contact $12c_1$ from the contact $12b_1$. Such being the case, as is seen from FIG. 4, the electric current flows through in succession the electric contact $12c_1$, the electric contact $12a_1$, the electric motor M, the electric contact $13a_1$, the electric contact $13b_1$ and the current detecting means 14. As the result, the electric current flows through the motor M in a direction as denoted by the broken arrow, whereby the window-regulator causes the windows to be lowered. Furthermore, at the same time, the electric current flows through both of the resistors $R_1$ and $R_2$ of the above-described type included in the logical operation circuit 15, whereby the output of the comparator 16 is rendered to be high and then, the transistor 17 is also rendered to be in an ON mode. Successively, the solenoid 7 is energized through the electric current introduced from a junction M through the diode $D_1$. However, according to such a small amount of displacement of the knob 1 as described above, i.e., a first displacement of the knob 1, since a distance between the core portion 5*a* of the solenoid 5 and the electromagnetizable member 9*b* of the yoke 9 is arranged to be rather long, the core portion 5*a* is not still electromagnetically attracted by the member 9*b* to the present invention. Furthermore, when the force being applied upon the shoulder 1*d* of the knob 1 in a manner as described above is released, the knob 1 is slidably returned to the initial, normal state, with the leading end of the operating portion 1*a* being also returned to the central portion of the central circumferential portion $2b_1$. Accordingly, such being the case, the operating portion 1*a* again stands substantially vertical, while being urged towards the central portion of the central circumferential portion. This is due to the fact that the resiliency of the spring 3 which urges the operating portion 1*a* towards the central portion $2b_1$ is arranged to be not so large enough to make the leading end of the operating portion 1*a* to be frictionally held at any position on the central portion $2b_1$, when the external force is released under the pressing condition of the knob 1 as described above.

On the other hand, in a case wherein the knob 1 is pressed at the other shoulder 1*c*, starting from the non-actuating state, due to the change-over of the switching means similar to the situation as described above, the electric current is to flow through the motor M in a direction as denoted by the solid line, whereby the window-regulator causes the windows to be raised. As soon as the external force being continuously applied upon the shoulder 1*c* is released, the knob 1 is slidably returned to the initial, normal state as described above.

In an operational mode of the knob 1 wherein the knob 1 is kept pressed at its shoulder 1*d* with a much higher external force relative to that required to effect the above-described first displacement of the knob 1, the pin-member 4 is first slidably moved towards the right on the central circumferential portion $2b_1$ and then, is further slidably moved on the sloped outer circumferential portion $2b_3$ after being mounted over the shoulder-like step portion $2b_2$, until the core portion 5*a* of the solenoid 5 is brought into an electromagnetic contact with the electromagnetizable plate 9*b* of the yoke 9. Similarly, in association with the pressing actuation of the shoulder 1*d* and its relating movements of the members as described earlier, the movable contacting member 12*a* is shifted by the movement of the interconnecting member 10*c*. Thus, the movable contacting member 12*a* is changed over from the contact $12b_1$ to the contact $12c_1$, whereby the motor M is energized in a manner as described earlier, thus resulting in the windows being lowered. Furthermore, as described earlier, at the same time, the logical operation circuit 15 is electrically applied through the diode $D_1$, whereby the output terminal of the comparator 16 is rendered to be high. Successively, the transistor 17 is rendered to be in an ON-mode and then, the solenoid 5 is energized through the point M and the diode $D_1$. Accordingly, the core portion 5*a* is effected to be in contact with the electromagnetizable member 9*b* of the yoke 9 and there, is maintained in an electromagnetically attracted state by the member 9*b*. Such being the case, wherein the knob 1 is left in the relative position as descirbed above with respect to the pivotal angle adjusting member 2*b*, even if the pressing force is released, the knob 1 can not be returned to the initial, normal state and is left in an actuating mode of automatic control. Accordingly, when the flow amount of the electric current through the electric motor M is increased, and the windows are in a fully open state, the electric potential being applied to the electric current detecting resistor 14 is rendered to be high, and the minus terminal of the comparator 16 is simultaneously rendered to be higher in electric potential than the plus terminal of the comparator 16. In the above-described electric condition of the comparator 16, since the output of the comparator 16 is rendered to be low in electric potential, the transistor 17 is rendered to be in an OFF mode, thus resulting in that the energization of the coil member 7 is electrically cut off. Therefore, the electromagnetic attractive hold of the core 5*a* with the electromagnetizable member 9*b* is also released, whereby the pin-member 4 itself, thus the knob 1, slidably descends in succession the sloped outer circumferential portion $2b_3$, the shoulder-like step portion $2b_2$ and then, the central circumferential portion $2b_1$, thereby taking the initial, normal position, since the resiliency specific to the spring 3 is arranged to be not so large enough to hold the pin-member 4 against its slidable descending tendency, which is substantially caused by the respective sloping gradients of these portions. In association with the self-return of the pin-member 4, the pressure exertion upon the interconnecting member 10, which has been caused by the operating portion 1*a*, is also released, whereby since the contact $12a_1$ is set free from the contact with the contact $12c_1$ due to the self-returning of the movable contacting plate member 12*a*, the energization of the electric motor M as well as the logical operation circuit is ceased, thus resulting in that the electric motor M is to be out of operation. On the other hand, in association with the correspondingly similar pressing actuation of the shoulder 1*c* and its relating movements of the members as described above, the core portion 5*a* is electromagnetically held by the electromagnetizable plate member 9*d*. Furthermore, upon the completion of a step of raising the windows, the knob 1 is returned to the normal, non-actuating position in a manner similar to that described above.

According to the switching assembly as described in the foregoing, not only the solenoid and the motor are both arranged to be simultaneously energized and deenergized, but also the window-regulator is to be effected either in the semi-automatic mode or in the automatic mode subject to the displacement amount of the knob 1. By the arrangement described above, the electric contacts are used for actuating the both of the motor and the solenoid, thus resulting in that the switching assembly required for the window-regulator can be simple in construction and is arranged to make the permissible flow capacity of the electric current to be higher when compared with the conventional switching assembly of the see-saw type. In addition, the switching assembly according to the present invention is inherently high in fatigue performance and can be manufactured at low cost. Moreover, according to the present window-regulator, the detraction of knob and its relating members are arranged to be performed by the function of the solenoid in accordance with the excess flow of the electric current which is caused in relation with the overload condition of the electric motor. According to the present switching assembly, the substantial portion for controlling the pivotal movement of the knob is provided as a portion of the casing, thereby to permit it to be correlated with the substantial portion of the switching assembly, and the bottom plate of the switching assembly itself is arranged to be available for a bottom covering plate of the assembly. Therefore, the present switching means can function in quite a effective manner and can be manufactured at low cost.

Referring now to FIGS. 8 to 14, there is shown one modified embodiment of the switching assembly according to the present invention.

The switching assembly comprises a manual knob 100 and an auto-knob 200, both knobs being pivotally mounted on a shaft 40 journaled by portions 100*a* of a casing 30, a solenoid 50 of the two direction operation type, a set 90 of a manual switching means, a set 110 of an auto-switching means, a manual card 70 and an auto-card 80.

More specifically, the assembly further comprises a spring 60 of resilient condition which is wound around the journal portion 100*a* of the manual knob 100. Respective portions extending from the wound portion are both in contact with respective lugs 100*b* and 100*b'* provided on the manual knob 100 to thereby prevent them from being further resiliently enlarged, and respective extremities of the extending portions thereof are both in close contact with respective lugs 30*a*, 30*b*, provided on the casing 30, to thereby enable them to be maintained in their respective resilient states. Accordingly, in association with a pivotal, counterclockwise movement of the manual knob 100 from its neutral position, as denoted by the solid line, to its alternative position, as denoted by the dotted line in FIG. 8, since one of the prolonged portions of the spring 60 of the above-described type is forcibly pivotably moved against the resilient force, while simultaneously another portion thereof is held by the lug 100*b*, the manual knob 100 positioned as described by the dotted line is left in an urged state towards the right. Therefore, if the external force being applied upon the knob 100 as described above is released, the lug 100*b* and the knob 100 itself are pivoted towards the left or clockwise by the spring force until the prolonged extremity is prevented from further being moved, whereby the knob 100 is to take the normal position. On the other hand, if the manual knob 100 is pivotally moved reversely, the knob 100 is returned to the normal position through a procedure similar to that described above.

As far as a pivotal movement of the auto-knob 200 is concerned, a spring member (not shown), which is available for the use for the auto-knob 200 and is arranged to be functioned in almost the same manner as that for the manual knob 100, is also provided. Thus, the auto-knob 200 is returned to its normal position with the help of the above-described spring member.

In order to prevent the occurrence of the excessive pivotal movement towards either the clockwise or counterclockwise direction, there is provided a stopper 30*b*, which is positioned on an inner face of the casing 30, to thereby cause an operating member 100*d* secured to the shaft 40 to be prevented from being moved in a clockwise direction by the stopper 30*b*, and a stopper member 100*c* secured to the shaft 40 is arranged to be prevented from being moved in a counterclockwise direction by an upper portion of the solenoid 50.

Figure 8:
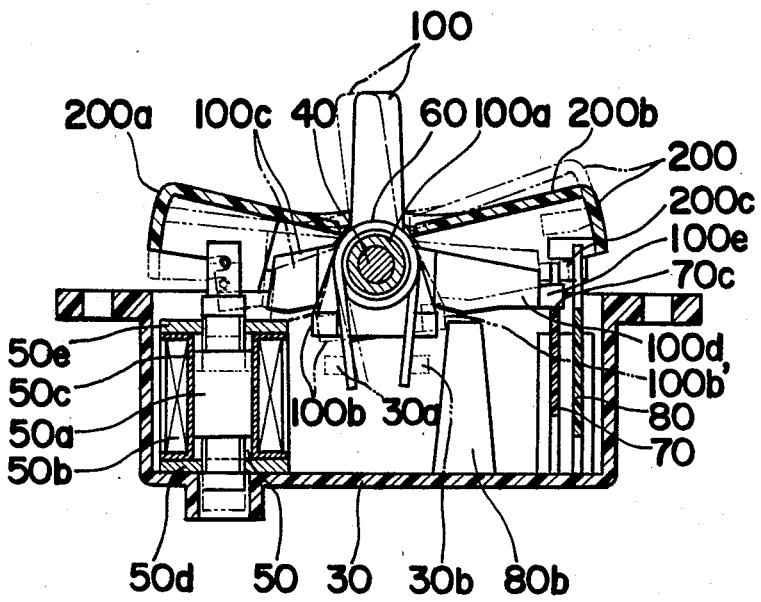
FIG. 8 is a schematic, front sectional view of a modified embodiment of FIG. 1, but particularly showing a view wherein switching plate members and their relating members are both omitted for clarity.

With respect to the solenoid 50, the solenoid 50 is the same type as employed for the former embodiment and has special characteristics as described earlier. Thus, as can be seen in FIG. 8, the solenoid 50 is secured to the inner face of the casing 30 at its one side. The core portion 50*a* is slidably incorporated inside the bobbin 50*c*, which is wound by the coil 50*b*. As described earlier, the core portion 50*a* is capable of being moved towards either of its longitudinal ends, i.e. the yoke 50*d* and the magnetizable plate member 50*e* and is electromagnetically maintained in one end to which the core portion 50*a* has been slidably moved. According to the present embodiment, an upper portion of the core portion 50*a* is connected to an operating portion 200*a* of the auto-knob 200 through the axle connection.

Figure 13:
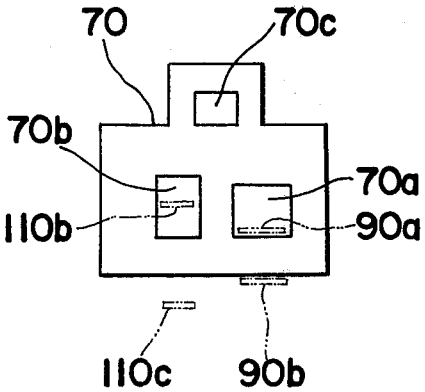
FIG. 13 is a schematic, front view of a card member of the manual switching unit.
Figure 14:
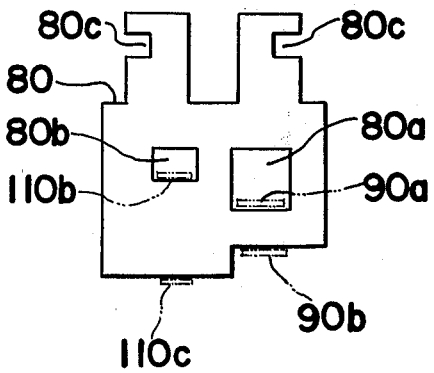
FIG. 14 is a view similar to FIG. 13, but particularly showing an auto-card member of the auto-switching unit.

As can be seen in FIGS. 13 and 14, the manual card 70 and the auto-card 80 each comprise a pair of guiding apertures, i.e. the pair of the apertures 70*a* and 70*b* and the pair of the apertures 80*a* and 80*b*. As will be specifically described hereinbelow, the aperture 70*a* and the aperture 80*a* are arranged to be extended through by a movable contacint plate member 90*a*, and the aperture 70*b* and the aperture 80*b* are arranged to be extended through by a movable contacting plate member 110*b*. Furthermore, the manual card 70 includes an aperture 70*c* at its uppr portion, to which a projected portion 100*e* integrally shaped in the operating member 100*d* is inserted, and the movable card 80 includes a pair of grooved portions 80*c* on either side of an upper circumference of the auto-card 80. Each of the paired grooved-portions 80*c* is provided for the auto-card 80, such that each of projected portions 200*c* formed in the operating member 200*b* of the auto-knob 200 can be engaged by the corresponding one of the above-described paired grooved portions 80*c*.

Figure 10:
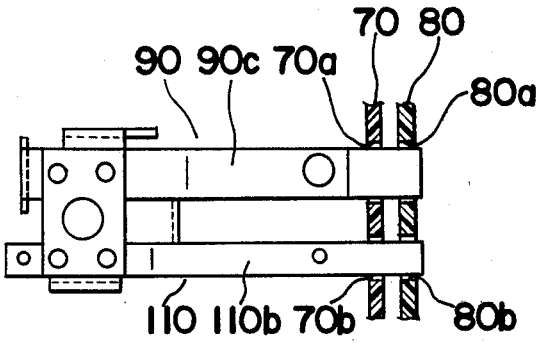
FIG. 10 is a schematic, top plain view, partially in section, of the switching plate members and their relating members of a switching means shown in FIG. 9.
Figure 11:
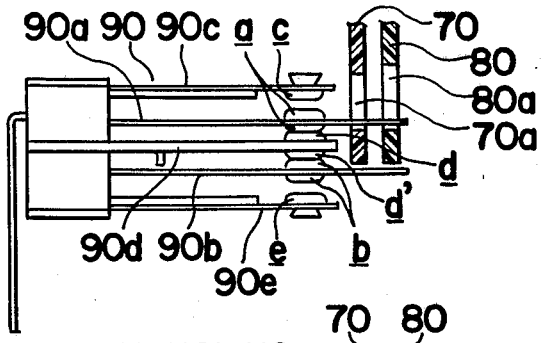
FIG. 11 is a schematic, side view, partially in section, of switching plate members of a manual switching unit and their relating members of the switching means shown in FIG. 8.
Figure 12:
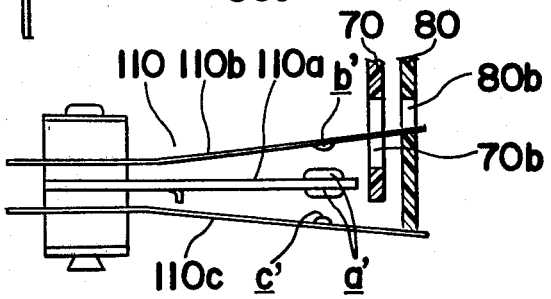
FIG. 12 is a view similar to FIG. 11, but particularly showing switching plate members of an auto-switching unit and their relating members of the switching means shown in FIG. 8.

As can be clearly seen in FIGS. 10 to 12, the manual switching means 90 comprises two movable contacting plate members 90*a* and 90*b*, and three fixedly disposed contacting plate members 90*c*, 90*d* and 90*e*. The movable contacting plate member 90*a* is arranged to be spacedly interposed between both of the fixedly disposed contacting plate members 90*c* and 90*d*, and a substantial length of the movable contacting plate member 90*a* is arranged to be relatively longer than those of the two fixedly disposed contacting plate members 90*c* and 90*d*, to thereby enable it to be engageable with the respective cards 70 and 80. Similarly, the movable contacting plate member 90*b* is arranged to be spacedly interposed between both of the fixedly disposed contacting plate members 90*d* and 90*e*, wherein the length of the movable contacting plate member 90*b* is also arranged to be relatively longer than those of the two fixedly disposed contacting plate members 90*d* and 90*e*. However, the five contacting plate members are spacedly disposed as the one unit, while being in a side by side relationship with respect to each other. More specifically, one of the contacts a provided on both sides of the plate member 90*a* faces a contact c provided on one side of the plate member 90*c*, while the other contact a faces a contact d provided on one side of the plate member 90*d*. Similarly, one of the contacts b provided on both sides of the plate member 90*b* faces a contact d′ provided on one side of the plate member 90*d*, while the other contact b faces a contact e provided on one side of the plate member 90*e*. The auto-switching means 110 comprises a fixedly disposed contacting plate member 110*a* and two movable contacting plate member 110*b* and 110*c*, and the fixedly disposed contacting plate member 110*a* is spacedly interposed between the two movable contacting plate members 110*b* and 110*c*. More specifically, a contact b′ of the plate member 110*b* is arranged to face one of contacts a′ provided on one side of the plate member 110*a*, while the other contact a′ of the plate member 110*a* provided on the other side of the plate member 110*a* faces a contact c′ provided on the plate member 110*c*. As can be seen in FIG. 12, the respective movable contacting plate members 110*b* and 110*c* are both arranged to be longer than the fixedly disposed contacting plate member 110*a*.

The manual card 70 and the auto-card 80 are spaced parallel to each other inside the casing 30, and their substantially lower portions are each slidably fitted inside paired guiding grooves (not shown). The respective grooves of each paired guiding grooves are formed on both of an inner front and back sides of the casing 30. Furthermore, both of the paired guiding grooves are provided inside the casing 30, such that the leading portion of the movable contacting plate member 90*a* of the manual switching means 90 can be extended through the guiding aperture 70*a* and the guiding aperture 80*a*, and the movable contacting plate member 110*a* of the auto-switching means 110 is simultaneously extended through the guiding aperture 70*b* and the guiding aperture 80*b* in succession.

As far as the contacting relationships among the respective contacts provided for both of the manual and auto-switching means is concerned, the following functional characteristics are brought about.

When both of the manual knob 100 together with the auto-knob 200 are both maintained in respective normal conditions, as for the manual switching means 90, the contact a and the contact d are closely contacted each other, and the contact d′ and the contact b are simultaneously closely contacted each other. However, such being the case, as for the auto-switching means 110, the contact a′ and the contact b′ are spaced apart from each other, and the other contact a′ and the contact c′ are spaced apart from each other at the same time. In accordance with a manipulation of the manual knob 100 in a counterclockwise direction with respect to FIGS. 8 and 9, the manual card 70 is kept raised in conjunction with the movable contacting plate member 90*a*, whereby the contact between the contact c and the contact a is effected, and the contact between the contact a and the contact d is naturally set free. The contact between the contact d′ and the contact b is, however, left unchanged. On the other hand, in accordance with a manipulation of the manual knob 100 in a clockwise direction with respect to FIGS. 8 and 9, the manual card 70 is kept lowered in conjunction with the movable contacting plate member 90*b* pushed downwardly by the bottom side of the manual card 70, whereby the contact between the contact b and the contact d′ is set free, and the contact between the contact b and the contact e is to be effected. However, such being the case, the contact between the contact a and the contact d is left unchanged.

Figure 9:
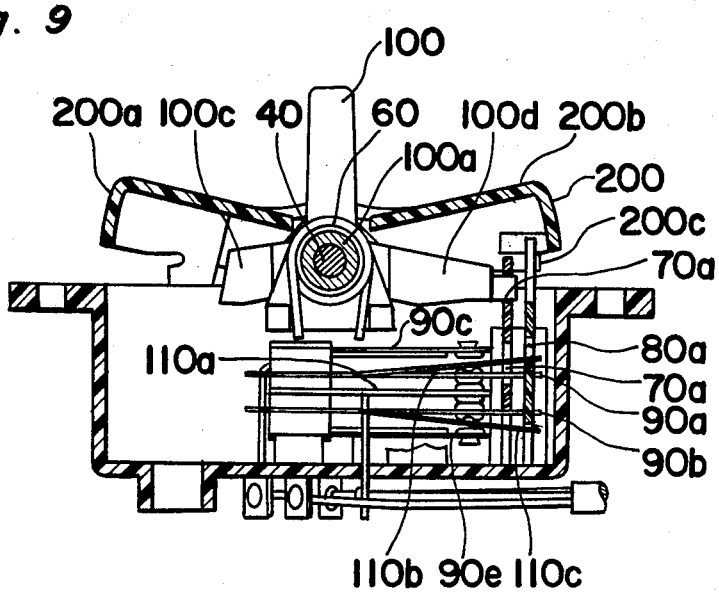
FIG. 9 is a view similar to FIG. 8, but particularly showing a view wherein a solenoid is omitted for clarity.

In association with a manipulation of the auto-knob 200 in a counterclockwise direction with respect to FIGS. 8 and 9, the auto-card 80 is kept raised in conjunction with the movable contacting plate member 90*a* and the movable contacting plate member 110 is also resiliently raised, whereby as for the manual switching means, the contact between the contact a and the contact c is effected in the same manner as the manual card 70 being raised, while as for the auto-switching means 110, a contact between the contact a′ and the contact c′ is effected. The respective contacting relations of the rest contacts of the manual and auto-switching means are, however, left unchanged. On the other hand, in accordance with a manipulation of the auto-knob 200 in a clockwise direction with respect to FIGS. 8 and 9, the auto-card 80 is kept lowered in conjunction with the movable contacting plate member 90*b* being pushed downwardly by the bottom side of the auto-card 80 and the movable contacting plate member 110*b* is also resiliently lowered, whereby as for the manual switching means, the contact between the contact b and the contact e is effected in the same manner as the manual card 70 being lowered, while as for the auto-switching means 110, the contact between the contact a′ and the contact b′ is simultaneously effected. The respective contacting relations of the rest contacts of the manual and auto-switching means are, however, left unchanged.

Figure 15:
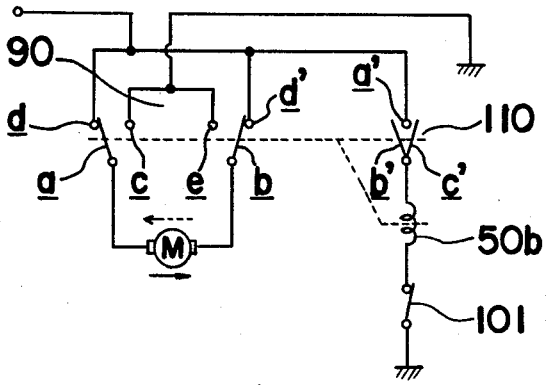
FIG. 15 is a view similar to FIG. 4, but particularly showing a modified embodiment of FIG. 4 in conjunction with the switching assembly shown in FIG. 8.
Figure 16:
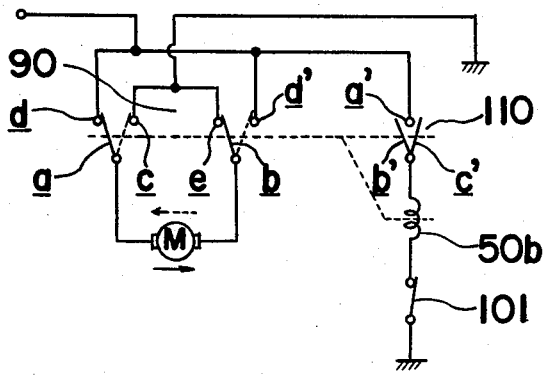
FIG. 16 is a view similar to FIG. 15, but particularly showing a manual control state of the window-regulator.
Figure 17:
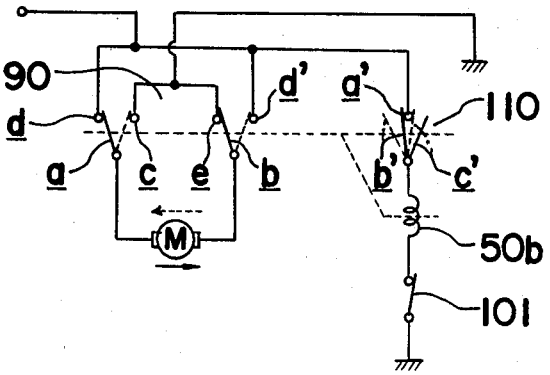
FIG. 17 is a view similar to FIG. 15, but particularly showing an auto-control state of the window regulator.

Referring now to FIGS. 15 to 17, there is shown a window-regulator in conjunction with the switching assembly of the second embodiment as described in the foregoing. In these figures, a notation M designates an electric motor. According to the window-regulator of this present embodiment, the windows are raised when the electric current flows in a direction as denoted by the solid line. On the other hand, when the electric current flows in a direction as denoted by the dotted line, the windows are lowered. A reference numeral 101 designates a limit-switch means whose contacts are electrically opened when either the windows are fully raised or the windows are fully lowered. The other like parts are designated by like reference numerals and notations as employed for describing the present embodiment in FIGS. 8 to 14.

By the arrangement described in the foregoing, the window-regulator of the present embodiment shown in FIGS. 15 to 17 functions as follows.

In a case wherein both of the manual knob 100 and the auto-knob 200 are maintained in their respective normal positions, both the manual card 70 and the auto-card 80 are also maintained in their respective normal positions, whereby the manual switching means 90 and the auto-switching means 110 are respectively maintained in such contacting states as specifically shown in FIG. 15. As is clear from the respective contacting states of the switching means, the motor is not energized and the window-regulator remains out of operation.

Starting from the normal state of the manual knob 100 as described above, when the knob 100 is turned down clockwise in FIGS. 8 and 9, the manual card 70 is lowered against the resilient force caused by the spring 60, and the movable contacting plate member 90*b* is pushed downward. Such being the case, since the contact b and the contact e are caused to be in contact with each other and since the electric circuit as denoted by the solid line is constituted, the electric current flows through the motor M in the direction as denoted by the solid line, thus resulting in the motor M being electrically driven to permit the windows to be raised. Upon releasing of the manipulation of the manual knob 100, since the manual knob 100 is returned to its normal position as shown in FIG. 8, the arrangement of the electric contacts as described above is interrupted, whereby the energization of the motor M is stopped. As is clear from the description in the foregoing, the operation of the manual knob 100 can be performed without causing any interferences upon the operation of the auto-switching means 110.

On the other hand, when the manual knob 100 is turned down counterclockwise against the resilient force, the manual card 70 is raised and the movable contacting plate member 90*a* is raised. Accordingly, the contact between the contact a and the contact c is effected, while the contact between the contact d′ and the contact b is left unchanged, whereby the electric circuit as denoted by the dotted line in FIG. 16 is effected. Such being the case, the electric current flows through the motor M in the direction as denoted by the dotted line, thus resulting in the motor M being electrically driven so as to cause the windows to be lowered. As far as the operational characteristics of the auto-knob 200 is concerned, starting from the normal state of the auto-knob 200 as shown in FIGS. 8 and 9, when the auto-knob 200 is actuated to effect the fully counterclockwise pivotal movement, the auto-card 80 is raised and the movable contacting plate member 110*c* is resiliently raised, while the movable contacting plate member 90*a* of the manual switching means 90 is also raised as described earlier. Such being the case, as can be effected in connection with the operation of the manual knob 100, the contact a of the manual switching means 90 is brought into contact with the contact c, whereby the electric motor M is electrically driven so that the windows are lowered. Furthermore, as described above, the movable contacting plate member 110*c*, which has been kept in the urged state with the bottom end of the auto-card 80 to thereby keep contact c′ in the electrically open state, comes into contact with the contact a′ of the fixedly disposed contacting member 110*a*. As soon as the arrangement of the contacts as described above is effected, as can be seen from FIG. 17, the coil 50*b* of the solenoid 50 is electrically energized. Since the core 60*a* per se is in contact with the yoke 50*b* with the help of the auto-knob 200, the core 50*a* and the yoke 50*d* are both electromagnetically attracted with respect to each other. Therefore, upon releasing the manipulation of the auto-knob 200, the counterclockwise pivotal state, which has been brought about in a manner as described above, is maintained unchanged. On the other hand, when it is necessary to release the above-described electromagnetic retention of the auto-knob 200, the manual knob 100 is further manipulated in the reverse direction. Such being the case, the end of the manual card 70 pushes the movable contacting plate member 110*c* of the auto-switching means 110, and since the contact between the contact a′ of the switching means 110 and the contact c′ of the same means is interrupted, the energization of the coil 50*b* of the solenoid 50 is interrupted. As soon as the electromagnetic attractive force effected between the core 50*a* and the yoke 50*d* disappears, the auto-knob 200 together with the auto-card 80 is returned to their respective normal states as shown in FIG. 8 by the spring force of a spring (not shown here). Alternatively, according to the present embodiment of the window-regulator, as soon as the windows are either fully lowered or fully raised, the limit switch means 101 is arranged to be opened, whereby the energization of the coil 50*b* of the solenoid 50 is stopped and the auto-knob 200 is successively returned to the normal state through the same procedure as described above.

On the other hand, when the auto-knob 200 is actuated to effect the fully clockwise pivotal movement, the auto-card 80 is lowered and the movable contacting plate member 110*b* of the auto-switching means 110 is pushed back, to thereby make the contact b′ to be in contact with the contact a′ while the movable contacting plate member 90*b* of the manual switching means 90 is pushed downward as described earlier. As a result, an electric circuit as denoted by the solid line in FIG. 17 is established, whereby the electric current flows through the motor M in the direction as denoted by the solid line, thus resulting in the electric motor M being driven so that the windows are raised. In addition, since the core portion 50*a* of the solenoid 50 is simultaneously electromagnetically attracted to the electromagnetizable plate member 50*e*, the electric motor M is kept rotating, unless either the limit switch means 101 is opened or the manual knob 100 is further pivotally moved in the reverse direction.

As is clear from the description in the foregoing, the switching means of this second embodiment is preferably employed in a sub-system of the powered control window system and the like, whereby the system itself can be constituted at low cost, since the present assembly is specifically provided with the self-retaining arrangement. Furthermore, the release of the automatic operation mode of such window-regulator or the like, which is being in operation with the help of the auto-switching means according to the present invention, can be accomplished by the separate manipulation of the manual switching means in quite a simple manner. This is due to the fact that the switching assembly of this second embodiment is not arranged to change-over the actuating mode of the switching means in two staged actuations as can be seen in the first embodiment of the present invention. Moreover, owing to the arrangement of this second embodiment, besides the arrangement in which the manipulation of the switching assembly can be carried out quite smoothly, such an undesirable switching condition as that the automatic mode of such the window-regulator is reversely effected can be avoided, which might be brought about in a case wherein the auto-switching mode is to be cancelled by the switching knob with a rather rough manipulating manner according to the first embodiment.

However, in spite of the several advantages specific to the second embodiment as described above, the first embodiment of the present invention has such the most favorable advantage that the switching assembly is capable of selectively energizing and de-energizing the motor incorporated in the window-regulator together with the solenoid means simultaneously, whereby the window-regulator can be operated in either the manual mode or in the automatic mode subject to the displacing amount of the single knob.

Although the present invention has been fully described by way of example with reference to the accompanying drawings, it is to be noted here that various changes and modifications are apparent to those skilled in the art. Therefore, unless otherwise such changes and modifications depart from the scope of the present invention, they should be construed as included therein.

What is claimed is:

1. A switching assembly to be incorporated in an electric regulator, which comprises:

a knob which is capable of being pivotally moved selectively clockwise and counterclockwise, with its operating leg portion being maintained in a downwardly urged condition;

a pivotal angle adjusting means, which defines respective paired first and second stages on either side of a basic stage, to thereby permit said operating leg portion of said knob to be selectively driven to one of said paired said first operating stage and said second operating stage via said first operating stage when said knob is pivotally moved selectively clockwise and counterclockwise;

two paired electric changing-over contacts each having a common contact electrically connected to a terminal of an electric motor, each of said two paired electric change-over contacts being correspondingly changed over in association with selective rightward and leftward drive of said operating leg portion with the help of a member interconnecting said operating leg portion with said respective electric changing-over contacts;

a self-retaining means which is capable of retaining said knob at one of said second stages subject to the condition that said knob is pivotally driven to said corresponding one of second stages;

an actuating means including a transistor for detecting an excess flow of electric current through said electric motor, said transistor operating said self-retaining means; and an electric circuit, wherein said self-retaining means is electrically connected to each of said common contacts through a respective diode;

wherein said pivotal angle adjusting means is either integrally formed with a casing or permanently affixed to said casing; and wherein said self-retaining means includes a bi-directionally operating type solenoid which is so arranged that, upon pivotal movement of said knob to said fist stage, the attraction of said solenoid can be set smaller than a restoring force of said knob, with said knob being capable of returning to a neutral position upon releasing said knob from an operating force, and upon pivotal movement of said knob to said second stage, the attraction of said solenoid can be set larger than said restoring force of said knob, with attracting forces thereof capable of self-retaining said knob at said second stage position.

2. A switching means as claimed in claim 1, wherein an upper circumferential configuration of said pivotal angle adjusting means is arranged to be symmetrical and comprises a central circumferential portion inwardly sloped, a pair of local portions stepwisedly provided on either outer side of said central circumferential portion and a pair of sloped outer circumferential portions on either outer side of said locally stepwise portions.

3. A switching assembly to be incorporated in an electric regulator, which comprises:

a knob which is capable of being pivotally moved selectively clockwise and counterclockwise, with its operating leg portion being maintained in a downwardly urged condition;

a pivotal angle adjusting means, which defines respective paired first and second stages on either side of a basic stage, to thereby permit said operating leg portion of said knob to be selectively driven to one of said paired said first operating stage and said second operating stage via said first operating stage when said knob is pivotally moved selectively clockwise and counterclockwise;

two paired electric changing-over contacts each having a common contact electrically connected to a terminal of an electric motor, each of said two paired electric change-over contacts being correspondingly changed over in association with selective rightward and leftward drive of said operating leg portion with the help of a member interconnecting said operating leg portion with said respective electric changing-over contacts;

a self-retaining means which is capable of retaining said knob at one of said second stages subject to the condition that said knob is pivotally driven to said corresponding one of second stages;

an actuating means including a transistor for detecting an excess flow of electric current through said electric motor, said transistor operating said self-retaining means; and an electric circuit, wherein said self-retaining means is electrically connected to each of said common contacts through a respective diode;

wherein said actuating means further comprises a pair of series-connected resistors of a resistance division type connected to junction of said diodes and self-retaining means; a comparator having a first input terminal is connected to both of said electrically breaking contacts of said respective two paired electric changing-over contacts and having a second input terminal connected to a junction point of said pair of series-connected resistors, both of said electrically breaking contacts being respectively electrically connected to a minus electrode of an electric source; and an electric current detecting resistor positioned between said first input terminal of said comparator and said minus electrode, an output of said comparator being connected to an input of said transistor, such that when said first input terminal of said comparator is higher in electric potential than said second input terminal, said transistor is rendered to be in an ON-stage and said self-retaining means is energized through a corresponding one of said respective diodes.

4. A switching assembly to be incorporated in an electric regulator, which comprises:

a knob which is capable of being pivotally moved selectively clockwise and counterclockwise, with its operating leg portion being maintained in a downwardly urged condition;

a pivotal angle adjusting means, which defines respective paired first and second stages on either side of a basic stage, to thereby permit said operating leg portion of said knob to be selectively driven to one of said paired said first operating stage and said second operating stage via said first operating stage when said knob is pivotally moved selectively clockwise and counterclockwise;

two paired electric changing-over contacts each having a common contact electrically connected to a terminal of an electric motor, each of said two paired electric change-over contacts being correspondingly changed over in association with selective rightward and leftward drive of said operating leg portion with the help of a member interconnecting said operating leg portion with said respective electric changing-over contacts;

a self-retaining means which is capable of retaining said knob at one of said second stages subject to the condition that said knob is pivotally driven to said corresponding one of second stages;

an actuator means including a transistor for detecting an excess flow of electric current through said electric motor, said transistor operating said self-retaining means; and an electric circuit, wherein said self-retaining means is electrically connected to each of said common contacts through a respective diode;

wherein said self-retaining means is a solenoid of a two directional operating type, which comprises:

a bobbin around which a coil member is wound;

a plunger which is almost entirely accommodated inside a through-bore of said bobbin and includes a core portion and, on either side of said core portion, a pair of end-portions each a relatively smaller diameter than said core portion;

an approximately U-shaped yoke member having an electromagnetizable side plate in which a first opening is provided for permitting one of said end-portions to pass through; and an electromagnetizable plate member having a second opening through which, when assembled, the other of said end-portions is to be passed, said electromagnetizable plate being arranged to be fit to said approximately U-shaped yoke member to thereby provide a box-like configuration, wherein said core is adapted to be selectively in electromagnetic contact with one of said magnetizable side plate of said approximately U-shaped yoke and said magnetizable plate with the help of said interconnecting member, subject to the condition that said operating leg portion of said knob is selectively driven to one of said second stages.

5. A switching assembly to be incorporated in an electric regulator, comprising:

a manual knob and an auto-knob which are pivotally moved selectively clockwise and counterclockwise;

a first spring and a second spring which are respectively arranged to urge said manual knob and said auto-knob to neutral positions independently of each other;

two pairs of electric change-over contacts each having a common contact electrically connected to opposite terminals of an electric motor, in which a normally closed contact and a normally open contact are respectively connected to either of a plus electrode and a minus electrode of a power source and the other of said plus electrode and said minus electrode;

a bi-directionally operating type solenoid having a coil;

two sets of normally closed contacts, each set having a first contact terminal connected to either said plus electrode or said minus electrode, and having a second contact terminal connected to said coil of said solenoid;

a manual card which is arranged to change over either pair of said two pairs of said electric change-over contacts when said manual knob has been pivotally moved clockwise, and to change over the other pair of said two pairs of said electric change-over contacts when said manual knob has been pivotally moved counterclockwise;

an auto-card which is arranged to hold said two normally closed contacts in an open state when said auto-knob is disposed at its neutral position, and is arranged to render either of said two normally closed contacts held in their open state to be in a closed state and to change over either pair of said two pairs of said electric change-over contacts when said auto-knob has been pivotally moved clockwise, and to render the other of said two normally closed contacts held in their open state to be in a closed state and to change over the other pair of said two pairs of said electric change-over contacts when said auto-knob has been pivotally moved counterclockwise;

said bi-directionally operating type solenoid forming a self-retaining means by moving in association with said auto-knob such that electric power is supplied to said coil of said solenoid through either of said two sets of normally closed contacts so as to self-retain said auto-knob clockwise or counterclockwise and to retain either pair of said two pairs of said electric change-over contacts in a change-over state when said auto-knob has been moved clockwise or counterclockwise; and a releasing means which interrupts a flow of electric current to said bi-directionally operating solenoid by opening said two sets of normally closed contacts by the use of said manual card through an operation of said manual knob in a direction opposite to that of said auto-knob so as to release said auto-knob from its self-retaining position when said auto-knob has been self-retained.

* * * * *